United States Patent [19]

Weisz

[11] 4,441,440

[45] Apr. 10, 1984

[54] PUSH-BUTTON CONTROL MODULE FOR A SEWING MACHINE

[75] Inventor: William Weisz, Tenafly, N.J.

[73] Assignee: The Singer Company, Stamford, Conn.

[21] Appl. No.: 449,721

[22] Filed: Dec. 14, 1982

[51] Int. Cl.[3] ..... D05B 3/02; D05B 3/04

[52] U.S. Cl. ..... 112/158 C

[58] Field of Search ..... 112/158 C, 158 B, 158 D, 112/158 A, 158 R; 200/340; 235/123

[56] References Cited

U.S. PATENT DOCUMENTS

| | | |
|---|---|---|
| 3,041,988 | 7/1962 | Fujita . |
| 3,085,526 | 4/1963 | Kawaguchi . |
| 3,156,205 | 11/1964 | Reeber et al. . |
| 3,217,677 | 11/1965 | Eguchi . |
| 3,279,402 | 10/1966 | Eguchi . |
| 3,332,380 | 7/1967 | Yanagibayashi . |
| 3,356,051 | 12/1967 | Eguchi . |
| 3,834,334 | 9/1974 | Adams et al. . |
| 3,841,246 | 10/1974 | Casner et al. . |
| 4,297,956 | 11/1981 | Meier . |
| 4,392,441 | 7/1983 | Eguchi ..... 112/158 B |

FOREIGN PATENT DOCUMENTS

| | | |
|---|---|---|
| 2840209 | 9/1978 | Fed. Rep. of Germany . |
| 2839963 | 9/1978 | Fed. Rep. of Germany . |
| 37-297356 | 4/1962 | Japan . |
| 39-588900 | 10/1964 | Japan . |
| 41-317941 | 1/1966 | Japan . |
| 50-400457 | 3/1975 | Japan . |
| 54-163151 | 12/1979 | Japan . |
| 55-30603 | 2/1980 | Japan . |
| 55-40594 | 3/1980 | Japan . |
| 56-136665 | 10/1981 | Japan . |
| 56-145480 | 11/1981 | Japan . |
| 56-145479 | 11/1981 | Japan . |

*Primary Examiner*—Henry Jaudon
*Assistant Examiner*—Andrew M. Falik
*Attorney, Agent, or Firm*—William V. Ebs; Robert E. Smith; Edward L. Bell

[57] ABSTRACT

A control module for a sewing machine includes a rectangular array of push-buttons which are slidably mounted for linear motion in a frame and include rearwardly extending portions in a single line engageable with cam followers slidably movable thereby into engagement with cams rotatable in the frame.

6 Claims, 18 Drawing Figures

PUSH-BUTTON CONTROL MODULE FOR A SEWING MACHINE

DESCRIPTION

BACKGROUND OF THE INVENTION

1. Field of the Invention

The invention relates to sewing machines with push-button controls.

2. Description of the Prior Art

It is well known to provide a sewing machine with pattern selecting push-buttons. Push-button controls may be seen, for example, in U.S. Pat. No. 4,297,956 for "Zig-Zag Sewing Machine Having Base-Mounted Operating Elements for Controlling Sewing" issued Nov. 3, 1981, in U.S. Pat. No. 3,217,677 for "Ornamental Stitch Sewing Machine" issued Nov. 16, 1965, and in U.S. Pat. No. 3,332,380 for "Device for Free Selection of Zig-Zag Pattern Discs in Sewing Machines" issued July 25, 1967.

It has been a disadvantage of prior push-button controls that they could not be conveniently compacted within a module in a manner making efficient use of the encompassed space. Space requirements necessitated the use of a large module not easily accommodated at a preferred location in a sewing machine, or the use of a limited number of push-buttons and associated pattern control elements.

It is a prime object of the present invention to provide a push-button pattern control module in which multiple rows of push-buttons and associated control elements are arranged in an improved manner efficiently utilizing the encompassed space.

It is another object of the invention to provide an improved push-button pattern control module in which a large number of push-buttons and associated control elements are efficiently arranged, and which is suited for installation in the standard of a sewing machine.

Other objects and advantages of the invention will become apparent during a reading of the specification taken in connection with the accompanying drawings.

SUMMARY OF THE INVENTION

A push-button control module is provided in accordance with the invention with a frame in which multiple rows of push-buttons are slidably supported for linear movement. The push-buttons include rear actuator portions which extend into a single row perpendicular to the linear direction of movement of the push-buttons. A plurality of stitch controlling cams are mounted for rotation in the frame, and a cam follower for each cam is slidably movable in the frame into engagement with its associated cam by the actuator portion of a push-button. The module further includes stitch controlling means operable by the cam followers.

DESCRIPTION OF THE PREFERRED EMBODIMENT

Figure 1:
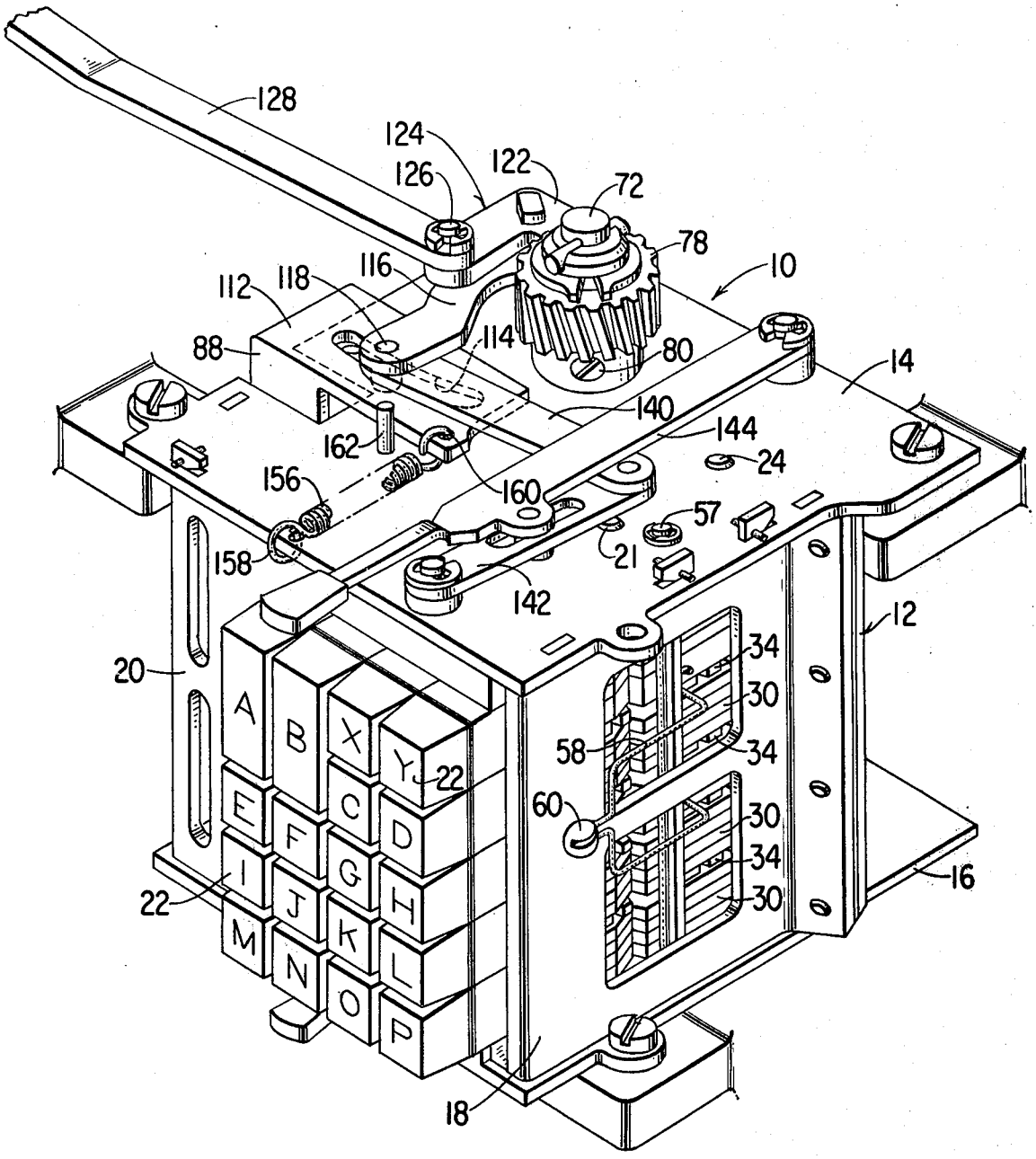
FIG. 1 is a perspective view of a sewing machine control module according to the invention.
Figure 2:
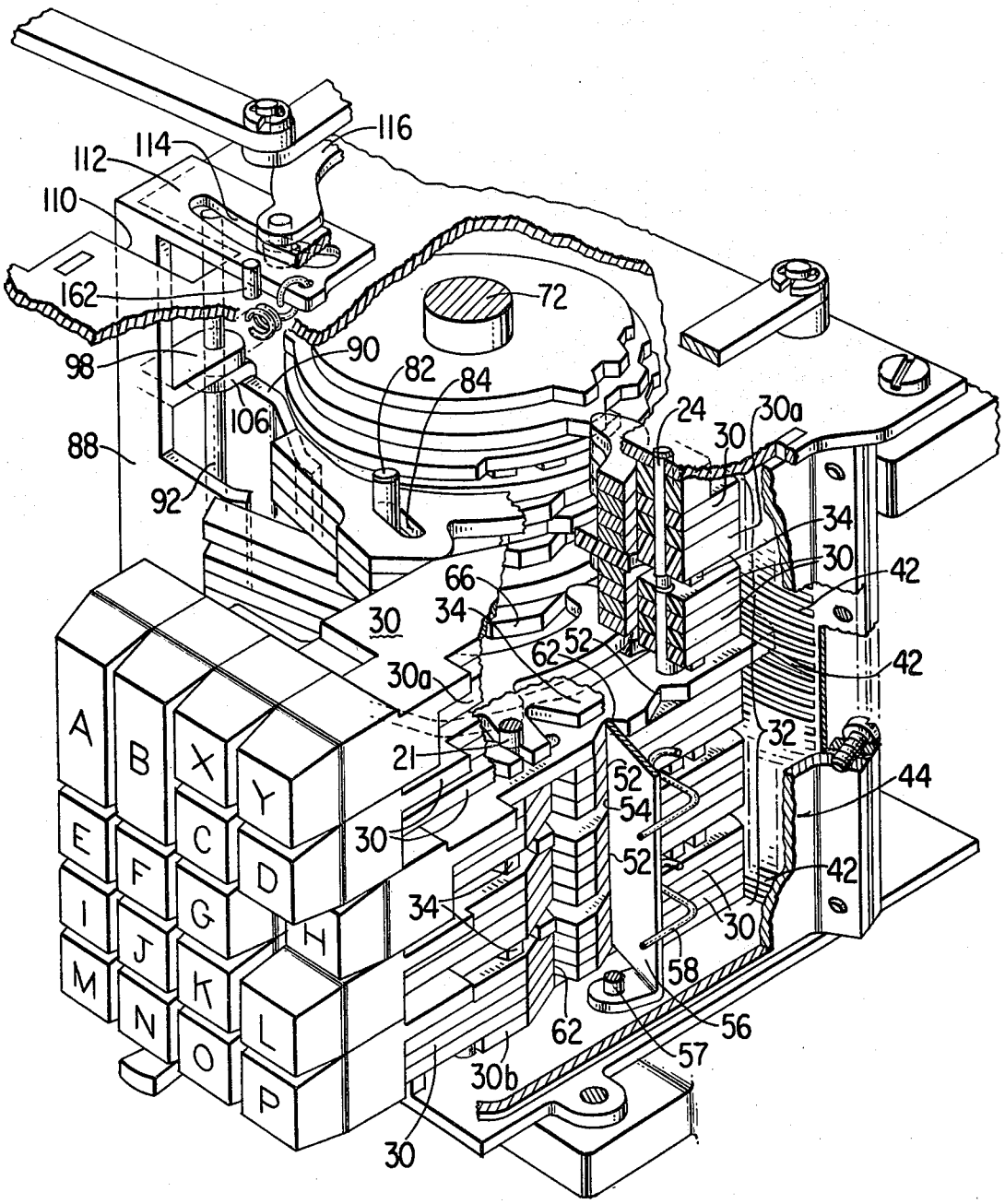
FIG. 2 is a perspective view of the module with portions broken away to show internal parts.

Referring to the drawings, reference character 10 designates a push-button control module according to the invention consisting of a frame 12 and various movable parts supported thereon. The frame includes top and bottom end plates 14 and 16 which are secured as by welding and/or other suitable means to a side plate 18 and a front corner member 20. Multiple rows of push-buttons 22 with individualized designations X and Y, and A through P are arranged in a rectangular array at the front of the module where the push-buttons normally project beyond the front edges of plates 14, 16 and 18 and beyond front corner member 20.

The push-buttons 22 are mounted for linear slidable movement on pins 21 and 24 extending between the end plates 14 and 16. Such pins pass through elongated slots 26 and 28 in rearward extensions 30 formed on the push-buttons to extend into a single row 32 perpendicular to the linear direction of push-button movement. Spaced apart plates 34 affixed on the pins 21 and 24 and disposed between groups of the extensions 30 lend support to the push-buttons. Adjacent push-button extensions 30 mutually engage on top and bottom surfaces, respectively, between the plates, and are slidable on one another along the engaging surfaces.

Each of the extensions 30 is engaged at the rear by a free end of 42, of a wire spring 44. The spring ends bias the push-buttons forwardly in the module into normal unactuated positions where extensions 30 are engaged in notches 52 by the edge 54 of a push-button latching plate 56. Plate 56 is pivotally mounted on a fixed pin 57 extending between plates 14 and 16, and is urged into engagement with the extensions 30 by a wire spring 58 which is affixed to plate 18 by a screw 60.

Each push-button 22 may be pushed from its unactuated position into an actuated stitch controlling position in which the plate 56 is caused to enter a second notch 62 in the push-button extension 30. As a button is pushed toward a latched position, wherein notch 62 therein is engaged by plate 56, any button previously moved into such latched position is released and returned by an associated spring end 42 to its normal unactuated position. A plurality of buttons are retained in latched actuated positions if depressed simultaneously.

Each of the push-buttons, A through P, is a control instrumentality which an operator can use singly or in combination to select the manner in which a needle shall be positioned during the sewing of work (except for buttonhole sewing) on a machine. Buttons X and Y are for use in controlling the formation of buttonholes, each being for a different width buttonhole. The buttonhole controlling buttons include, in addition to the integral extensions 30, a floating extension 30*a* which is mounted in the module in the same fashion as the integral extensions, that is, on pins 21 and 24 extending through elongate slots 26*a* and 28*a*, in the part. The floating extension is biased by a spring end 42 into engagement with the buttonhole controlling buttons and when either of such buttons is pushed, the floating extension is moved by the button along with its integral extension. Notches 52*a* and 62*a* are provided on the floating extension to receive the edge of plate 56.

Push-button extensions 30 and 30*a* are located in row 32 along with a member 30*b* having the same general configuration as the extensions. Member 30*b* is mounted for slidable motion on pins 21 and 24 which pass through elongate slots 26*b* and 28*b*, in the part. A spring end 42 biases member 30*b* forwardly into engagement with a link 64 by means of which the member may be moved rearwardly.

The module is provided with a cam 66 for each push-button extension 30, a pair of cams 66$a_1$ and 66$a_2$ for the floating extension 30*a*, and a cam 66*b* for member 30*b*. The module is further provided with a cam follower 68 for each cam 66, cam followers 68$a_1$ and 68$a_2$ for cams 66$a_1$ and 66$a_2$, respectively, and a cam follower 68*b* for cam 66*b*. Each of the cams is in a common plane with its associated cam follower and associated extension 30, floating extension 30*a* or member 30*b*. All of the cams with the exception of cam 66$a_2$ and two of the cams 66 associated with extensions 30 on push-buttons X and Y are part of a cylindrical member 70 which is suitably affixed on a shaft 72 that is rotatably mounted in bearings (not shown) located in plates 14 and 16. The excepted cams, although also mounted on shaft 72, are separate members which cam be clutched to and declutched from the shaft for a purpose hereinafter described. Shaft 72 extends parallel to push-button row 32 and projects above plate 16 to receive a gear 78 which is secured to the shaft with a screw 80. The cam followers are mounted on a pin 82 extending between and fixed in plates 14 and 16. The pin passes through elongate holes 84 in cam followers 68, 68$a_1$, 68$a_2$ and 68*b*. Adjacent cam followers mutually engage on top and bottom surfaces between the plates and are slidable across one another on the engaging surfaces.

A needle plate 88 and a feed wobble plate 90 are mounted for pivotal motion about a common axis defined by a shaft 92 extending in a direction parallel to push-button row 32 and fixed in plates 14 and 16. The shaft passes through bores in tabs 98 and 100 on plate 88, and through bores in tabs 106 and 108 on plate 90. The needle plate 88 extends through a slot 110 in plate 14 and terminates in a bracket 112 just above the surface of plate 14. Bracket 112 includes an arcuate slot 114 having a radius corresponding to the effective length L of a bracket connecting link 116, and having one end positionable directly over the pivotal axis of needle plate 88. Link 116 carries a pin 118 at one end, and a pin 120 at the other end. Pin 116 extends into slot 114 and pin 120 pivotally connect link 116 to one arm 122 of a needle bight controlling bell crank 124. The other end of the bell crank pivotally connects at 126 with a needle bight controlling link 128. The bell crank is pivotally movable on a pin 130 which is slidable in a slot 132 provided in plate 14. As shown, the pin 130 extends through slot 132 to connect with one end of a member 134 which is slidable at the opposite end in a slot 136 on shaft 92. A strong compression spring 138 acts against member 134 and causes pin 130, except during a buttonholing operation as described hereinafter, to assume a limiting position at the end of plate slot 132.

A linkage system including links 140, 142 and 144 is provided for positioning pin 118 in slot 114. Link 140 is pivotally connected at one end to pin 118 and at the other end to a pin 141 in one end of link 142. The opposite end of link 142 is pivotally mounted in plate 14 at 146. Link 142 includes a slot 148 in which a pin 150 extending from a tab 152 at an intermediate location on the link 144 is received. One end of link 144 is pivoted at 154 in plate 14, whereas the opposite end is free and can be moved by an operator to position pin 118 in slot 114. A coil spring 156 having one end 158 anchored in plate 14 and the other end connected at 160 to bracket 112 biases the bracket toward a limiting position defined by a stop 162.

A stitch length control bracket 164 is pivotally mounted on a shaft 166 which is affixed in the wings 168 and 178 of a member 180 that is affixed with screws 182 and 184 on plate 16. A tension spring 186 shown between member 180 and a stitch length controlling arm 188 on bracket 164 biases the bracket in a direction causing a projecting edge 190 on arm 188 to engage a cam 192 formed on one end of a link 194. The link 194 is pivotally mounted in plate 16 on a pin 196, whereas the other end is free and can be moved by an operator to selectively position the bracket 164 including the arm 188 on shaft 166.

An operator programs a machine for straight stitch sewing with push-button A, for zig-zag sewing with push-button B, for pattern sewing with any one or more of push-buttons C through P, and for buttonhole sewing with push-button X or Y depending upon the width of buttonhole desired.

Figure 9:
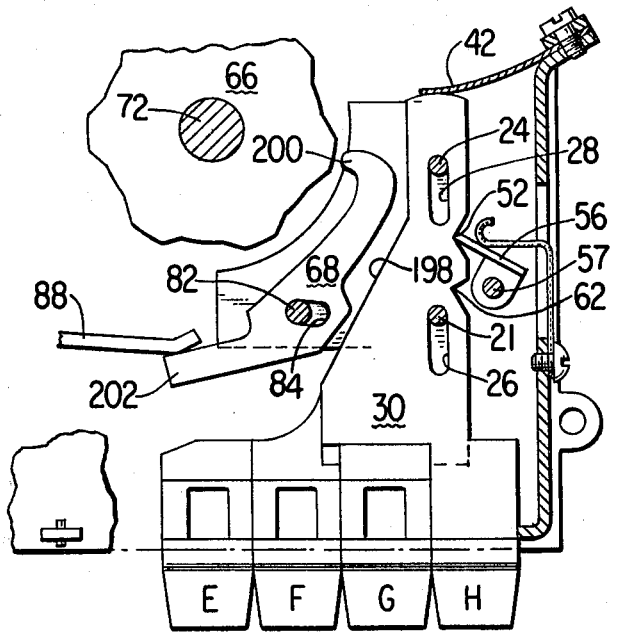
FIG. 9 is a view on the plane of the line 9—9 of FIG. 6.
Figure 8:
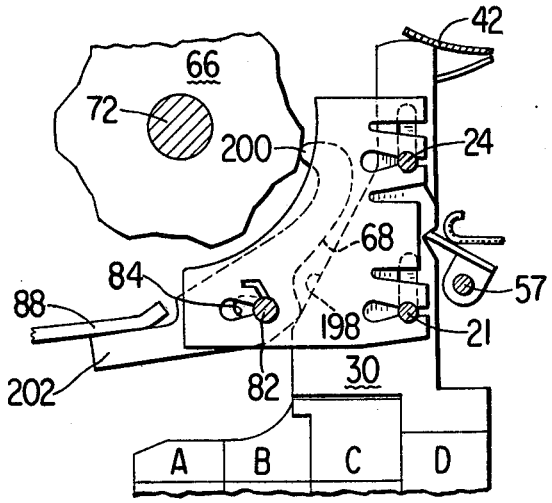
FIG. 8 is a view taken on the plane of the line 8—8 of FIG. 6.
Figure 12:
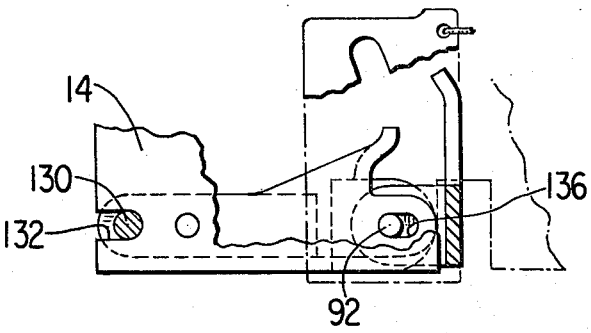
FIG. 12 is a view taken on the plane of the line 12—12 of FIG. 11.
Figure 11:
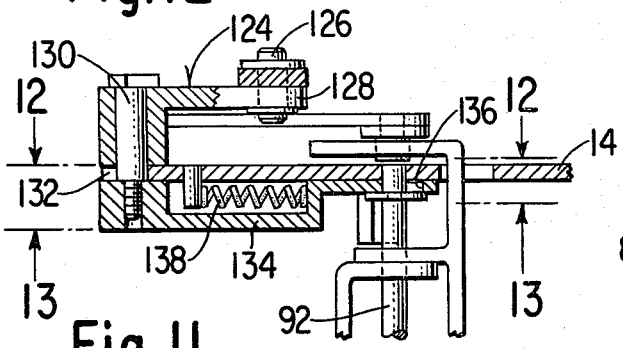
FIG. 11 is a sectional view taken on the plane of the line 11—11 of FIG. 4.
Figure 13:
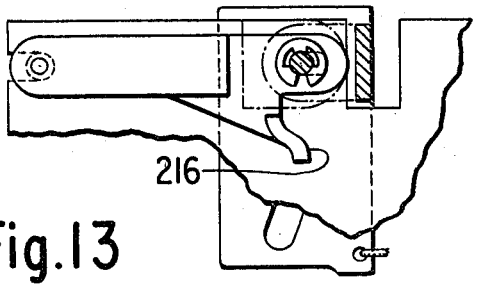
FIG. 13 is a view taken on the plane of the line 13—13 of FIG. 11.
Figure 10:
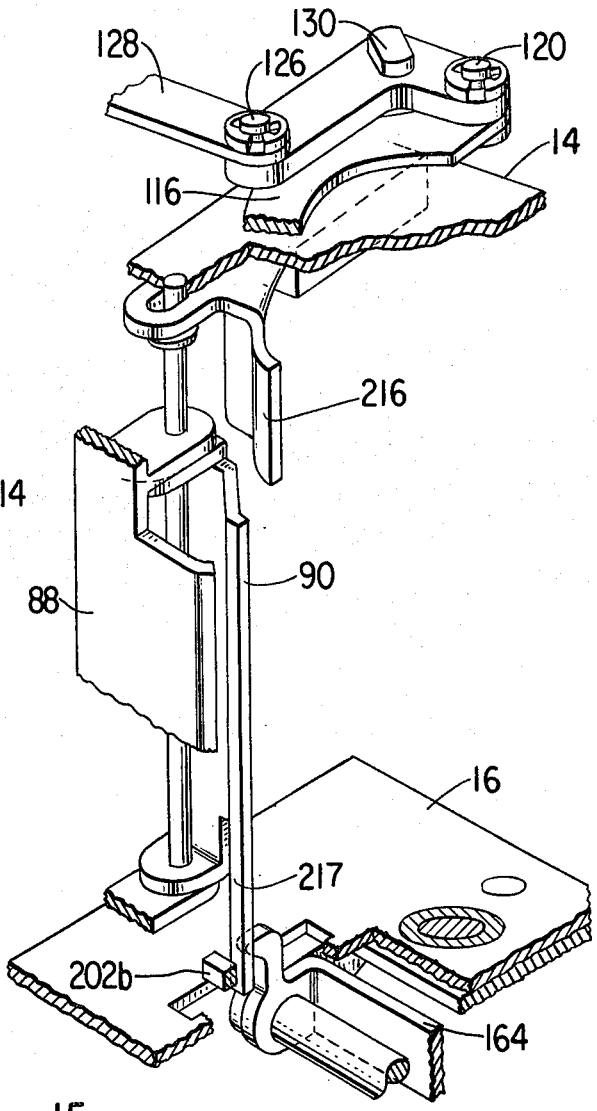
FIG. 10 is a fragmentary perspective view showing a portion of the module.
Figure 14:
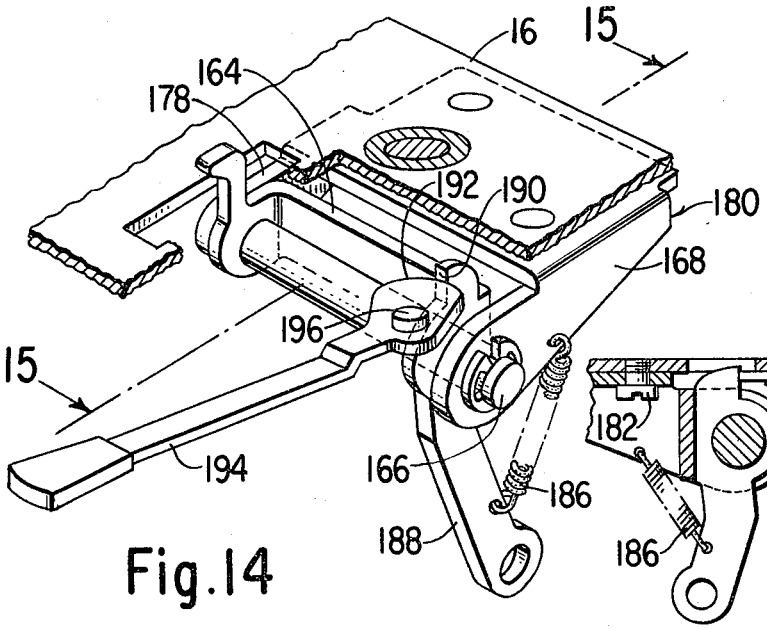
FIG. 14 is a fragmentary perspective view showing stitch length controlling mechanism at the bottom of the module.
Figure 15:
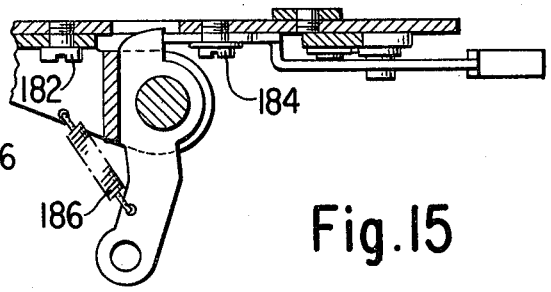
FIG. 15 is a sectional view taken on the plane of the line 15—15 of FIG. 14.

When any one of buttons B or C through P is pushed from an unactuated into an actuated position (see FIGS. 9 and 8 respectively), its coplanar cam follower 68 is caused to ride up along edge 198 of the push-button extension 30 and assume an activated position of enforced engagement at one end 200 with the associated cam 66 and at the opposite end 202 with needle plate 88. As cam shaft 72 rotates the engaged cam during operation of the machine, the follower is rocked in a manner determined by the profile of the cam about the push-button extension serving as a supporting fulcrum. The follower positions and imparts pivotal movement to needle plate 88, and the needle plate acting through bracket 112, pin 118, link 116, crank 124 and link 128 controls the positioning and side to side movement of a needle bar (not shown). The needle bight obtainable with any particular cam rendered effective by any one of the buttons B through P, can be selectively determined by the positioning of pin 118 in slot 114 with link 144. Movement of the pin 118 away from the pivotal axis of needle plate 88 at the one end of the slot increases the amplitude of movement of pin 88 to increase bight, whereas movement toward the needle plate axis decreases the amplitude of movement of pin 88 to decrease bight.

When push-button A is pushed into an actuated position, its coplanar cam follower 68 is moved into a position against its associated cam 66 and the needle plate 88 in the same manner as a cam follower activated by one of buttons B or C through P. However, the cam associated with button A is provided with a smooth profile. Engagement of the cam follower with such cam therefor results in a needle bar being disposed in a position determined by the elevation of the cam, but does not result in the needle being moved from side to side.

Figure 3:
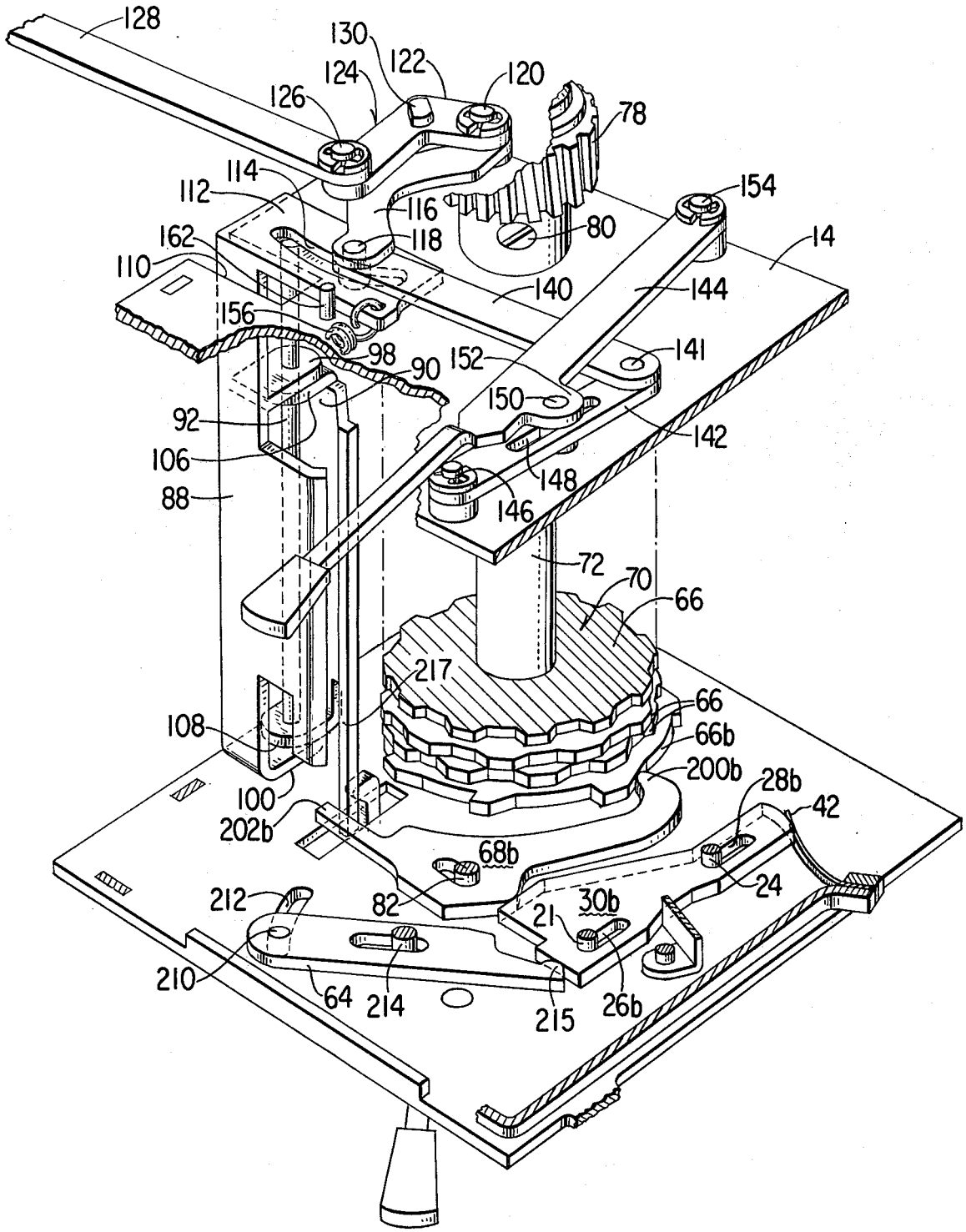
FIG. 3 is a perspective view of the module with portions broken away and parts removed to better show certain parts of the sevice.
Figure 4:
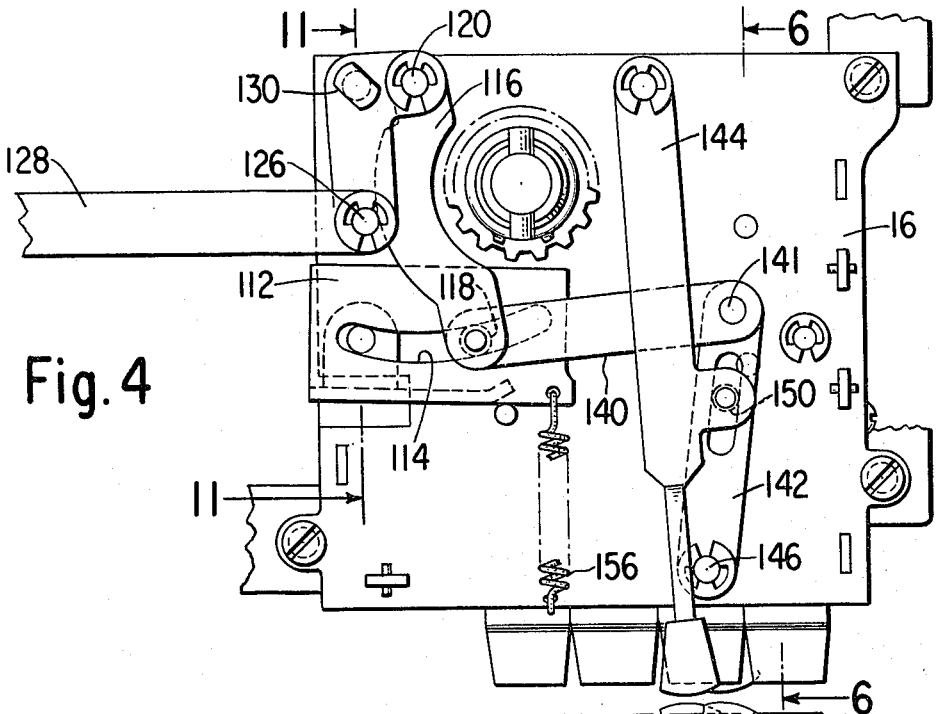
FIG. 4 is a top plan view of the module.
Figure 5:
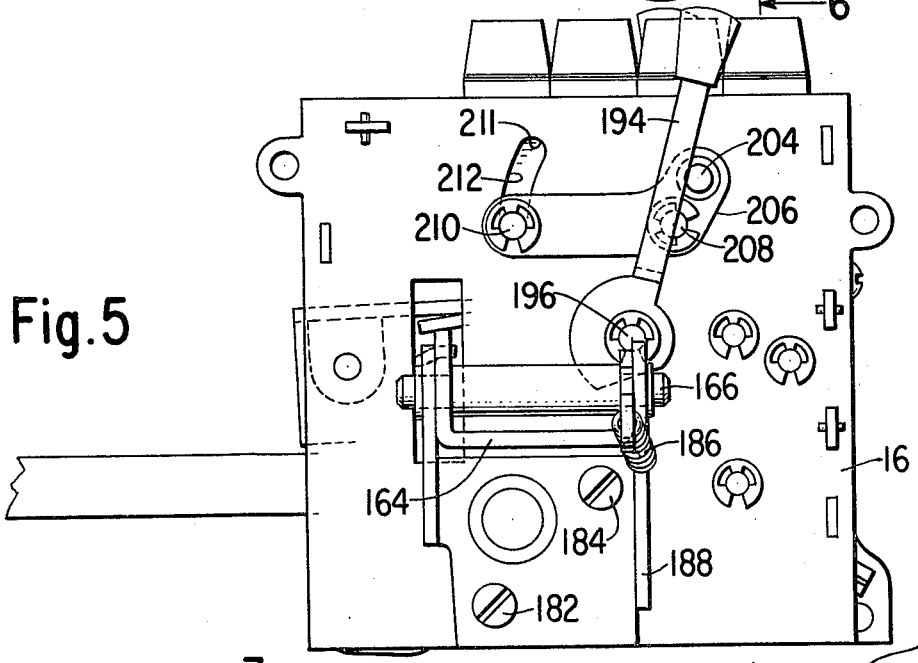
FIG. 5 is a bottom view of the module.
Figure 6:
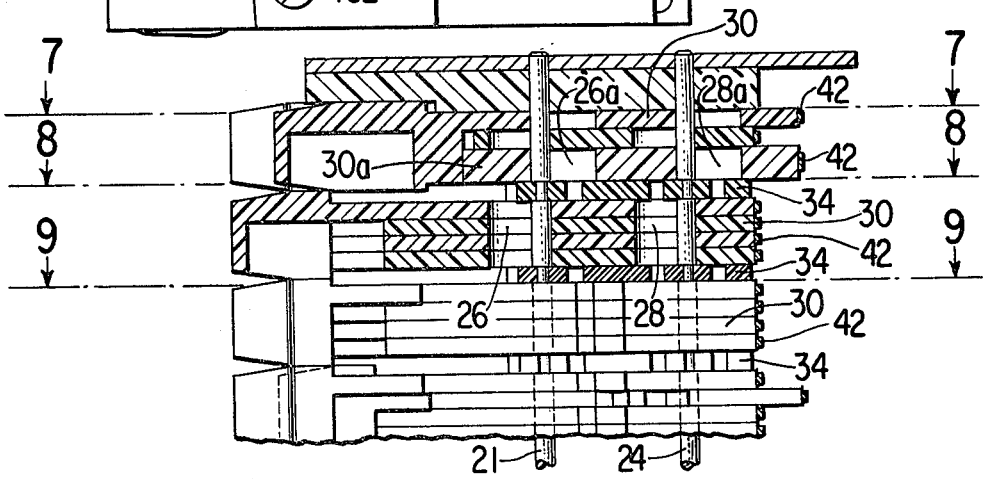
FIG. 6 is a sectional view taken on the plane of the line 6—6 of FIG. 4.

Stitch length for any of the various types of stitches obtainable with buttons A through P can be selectively determined by the positioning of link 194 (to the left of a pin 204 as viewed in FIG. 5), and the positioning thereby of feed regulating mechanism (not shown) suitably connected to arm 188 on bracket 164. Such feed regulating mechanism may be of the kind shown, for example, in U.S. Pat. No. 3,527,183 for "Work Feeding Mechanism for Sewing Machine" of Jan Szostak issued Sept. 8, 1970. Link 194 may also be positioned to bring about the cam controlled feeding of work during the formation of any pattern stitch selected with the push-buttons. Cam controlled feeding is brought into play by the movement of link 194 into engagement with pin 204 which is affixed in one end of a member 206 pivoted at 208 in plate 16, and the further movement of link 194 into an extreme position defined by engagement of a pin 210 on member 206 with end 211 of a slot 212 in plate 16 through which the said pin 210 extends to pivotally connect member 206 with member 64. Member 64 (see FIG. 3) is slidable and pivotable on a pin 214 in plate 16, and has a free end 215 which moves member **30*b* and results in follower 68*b* being disposed in a supported position wherein opposite ends 200*b* and 202*b* of the cam follower are in engagement with cam 66*b* and the feed wobble plate 90, respectively. As cam 66*b* is rotated by shaft 72, follower 68*b* is actuated by the cam. The follower actuates the feed wobble plate 90, and a finger 217 on the wobble plate acting against bracket 164 actuates feed regulating mechanism connected to the bracket, all according to the profile of cam 66*b***.

Figure 7:
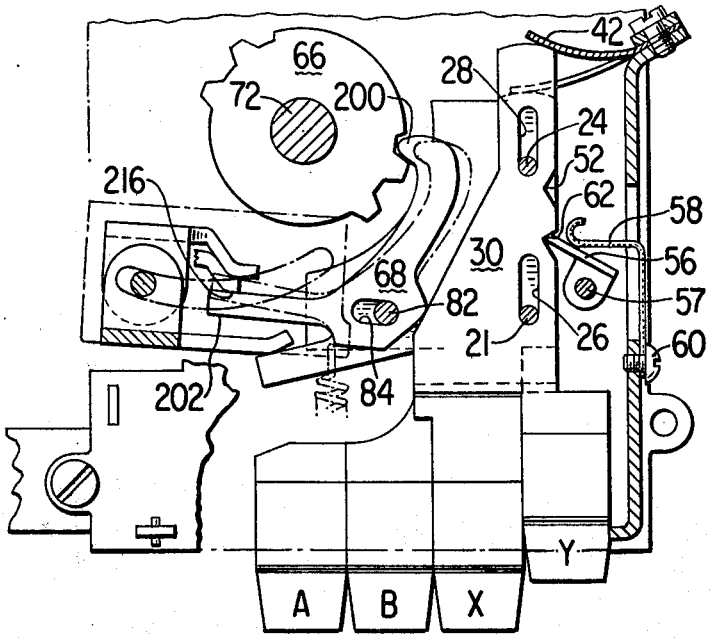
FIG. 7 is a view taken on the plane of the line 7—7 of FIG. 6.
Figure 17:
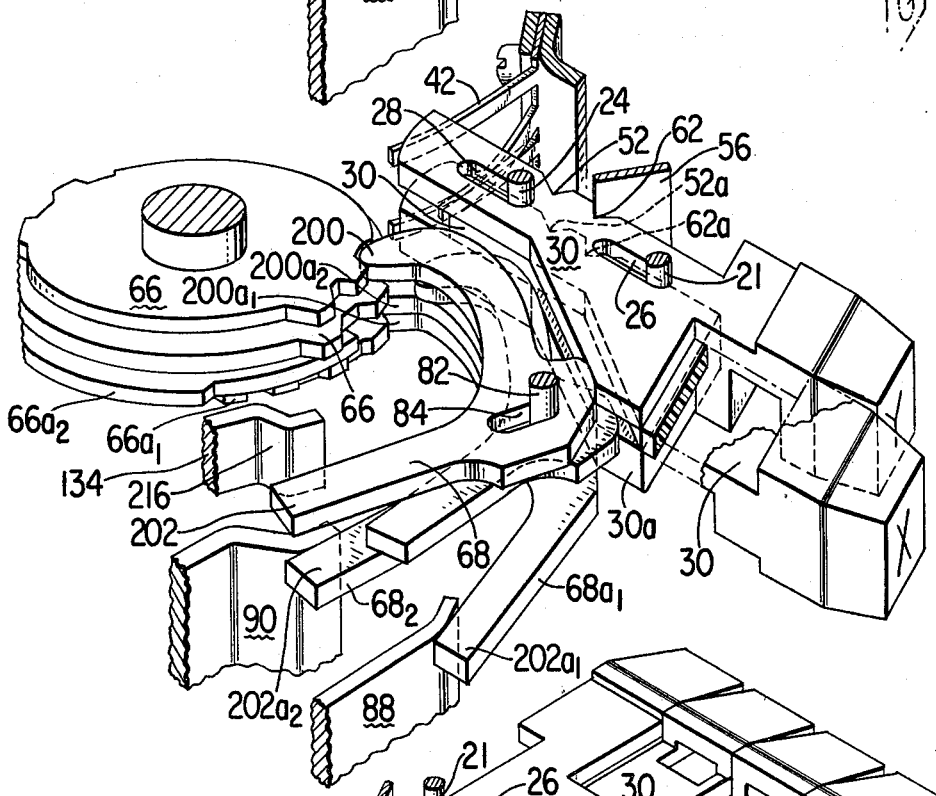
Figure 18:
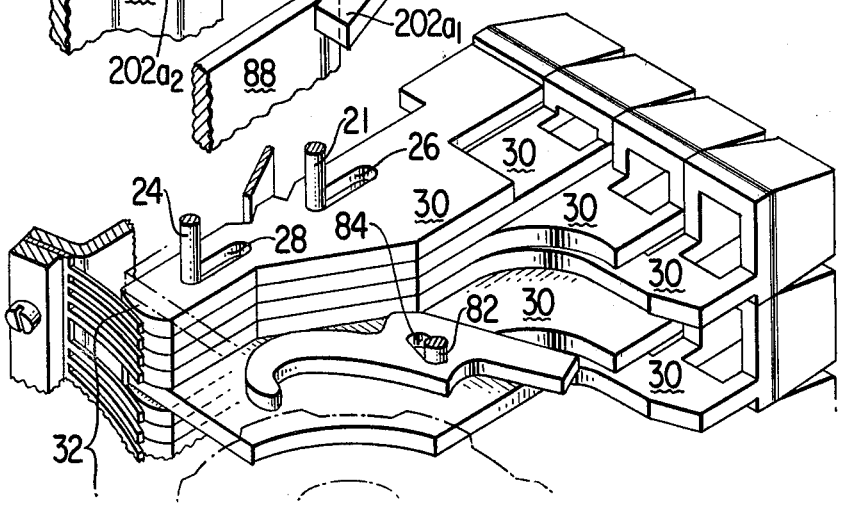

When button Y is pushed into a latched position (see FIGS. 7 and 17) its integral extension 30 moves the coplanar cam follower 68 into a supported position thereon and into enforced engagement at opposite ends 200 and 202 with a topmost one of a pair of adjacent buttonhole cams 66 and a flange 216 on member 134, respectively. At the same time, floating extension **30*a* is caused by button Y to move cam followers $68a_1$ and $68a_2$ into supported positions thereon and into enforced engagement at ends $200a_1$ and $200a_2$ with coplaner buttonhole cams $66a_1$ and $66a_2$, respectively, and at opposite ends $202a_1$ and $202a_2$ with the needle plate 88 and feed wobble plate 90, respectively. Member 134, needle plate 88 and feed wobble plate 90 are controlled in accordance with the profile of the said buttonhole cams 66, $66a_1$ and $66a_2$ respectively, during their rotation by shaft 72**.

Figure 16:
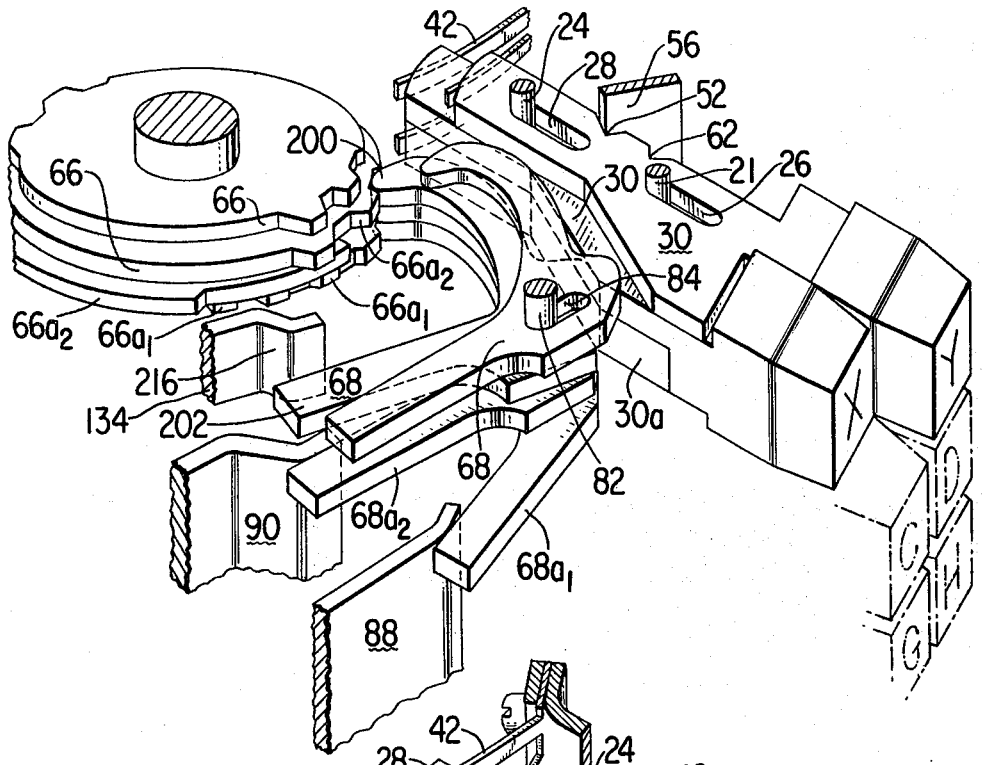
FIGS. 16 and 17 are enlarged fragmentary views showing buttonholing controls in the module; and, FIG. 18 is an enlarged fragmentary perspective view showing stacked buttons on a supporting plate in the module.

If button X is moved into an actuated position (see FIG. 16) instead of button Y, cams $66a_1$ and $66a_2$ are rendered effective as before by the positioning of cam followers $68a_1$ and $68a_2$, with floating extension **30*a*, however, a different cam 66 that is the one just under the topmost cam 66, is rendered effective by the positioning of its cam follower with the extension 30 on button X. The cam 66** rendered effective with button X is profiled to provide for the formation of a wider buttonhole than is possible with the cam brought into play with button Y, and barring operation are controlled accordingly. Otherwise, the buttonholing operations correspond to those occurring while button Y is in a latched position.

Buttonhole cams 66, $66a_1$ and $66a_2$ are of a well known type used in buttonhole sewing, the buttonhole cams 66 being needle positioning and barring cams, cam $66a_1$ being a needle zig-zag cam, and cam $66a_2$ being a feed direction controlling cam. Clutching and tripping control means (not shown) of a kind such as disclosed in U.S. Pat. No. 3,841,246 for "One-Step Buttonhole Operating and Indicating Devices" of John W. Casner et al issued Oct. 15, 1974, drivably connect and disconnect the needle positioning and barring cams to and from drive shaft 72 during the sewing of a buttonhole as required to effect the formation of a buttonhole of a perdetermined length.

A buttonhole cam 66 acting through its coplanar cam follower 68 and spring biased member 134 in engagement at flange 216 with the follower controls the position and movement of bell crank pin 130 in plate slot 132 and thereby the position and movement of the bell crank about pin 120 as needed for the bell crank to impart side to side movement to a needle bar with link 128 in a manner providing for the formation of barring stitches at the end of a buttonhole and for the bell crank to dispose the needle bar on each of opposite buttonhole sides where zig-zag stitches are called for.

Cam $66a_1$, which is a continuously rotating cam, acts through cam follower $68a_1$, needle plate 88, bracket 112, pin 118 and crank 124 to pivot the bell crank about pin 130 and so cause link 128 to impart zig-zag motion to a needle bar for use in forming the opposite side stitches. The zig-zag motion, which is continuous, is merely supplemental to side to side motion imparted to a needle bar during the formation of barring stitches.

Cam $66a_2$, acting through cam follower $68a_2$, feed wobble plate 90 and finger 218 on shaft 166 in enforced engagement with plate 90, by reason of spring 186, positions shaft 166 and bracket arm 188 to control feed regulating mechanism connected thereto and so provide for the feeding of material in a forward and reverse direction during the formation of a buttonhole.

The module 10 may be installed in the standard of a sewing machine with the push-buttons 20, bight controlling link 144, and stitch length controlling link 194 extending through the shell of the machine. The controls are then readily accessible to an operator, and the module is conveniently oriented for operatively connecting the cam shaft 72 to the arm shaft of the machine and arm 188 to stitch regulating mechanism in the base of the machine.

It is to be understood that the present disclosure relates to a preferred embodiment of the invention which is for purposes of illustration only and is not to be construed as a limitation of the invention. Numerous alterations and modifications of the structure herein disclosed will suggest themselves to those skilled in the art, and all such modifications and alterations which do not depart from the spirit and scope of the invention are intended to be included within the scope of the appended claims.

I claim:

1. A control module for a sewing machine, the said module including a structural frame, multiple rows of push-buttons slidably mounted for linear motion in the frame and including rear portions extending into a single row perpendicular to the linear direction of movement of the push-buttons, a plurality of stitch controlling cams mounted for rotation in said frame, a cam follower for each such cam slidably movable in the frame into engagement with its associated cam by the rear portion of a push-button in said row and movable in the frame by the engaged cam, and stitch controlling means operable by the cam followers, the stitch controlling means including a needle bight controlling plate and a feed controlling wobble plate mounted on the frame for pivotal movement about a common axis, the needle bight controlling wobble plate being engageable by certain of the cam followers and the feed controlling plate being engageable by other cam followers.

2. A control module according to claim 1 wherein the axis of rotation of the cams and the axes of the needle bight controlling plate and feed wobble plate are parallel to said push-button row.

3. A control module according to claim 1 including means operatively associated with the feed wobble plate for manually controlling stitch length.

4. A control module according to claim 1 including means operatively associated with a needle bight plate for manually controlling bight.

5. A control module according to claim 1 wherein the structural frame includes end plates and means for supporting the push-buttons, cams, cam followers needle bight plate and feed wobble plate therebetween for stitch controlling movements.

6. A control module according to claim 5 including means mounted on one of the end plates and operatively associated with the feed wobble plate for manually controlling stitch length, and means mounted on the other end plate and operatively associated with the needle bight plate for manually controlling bight.

* * * * *